US006997794B2

(12) United States Patent
Pontieri

(10) Patent No.: US 6,997,794 B2
(45) Date of Patent: Feb. 14, 2006

(54) SANDING ROPE AND METHOD OF FORMING SAME

(76) Inventor: James Matthew Pontieri, 36291 Jared, Sterling Heights, MI (US) 48312

( * ) Notice: Subject to any disclaimer, the term of this patent is extended or adjusted under 35 U.S.C. 154(b) by 0 days.

(21) Appl. No.: 10/860,694

(22) Filed: Jun. 3, 2004

(65) Prior Publication Data

US 2005/0272361 A1 Dec. 8, 2005

(51) Int. Cl.
*B24D 11/00* (2006.01)

(52) U.S. Cl. ..... 451/533; 451/523; 451/913

(58) Field of Classification Search ..... 451/533, 451/534, 552, 555, 523–525, 495, 514, 515, 451/520, 541, 522, 913
See application file for complete search history.

(56) References Cited

U.S. PATENT DOCUMENTS

| | | | | |
|---|---|---|---|---|
| 2,024,591 A | * | 12/1935 | Manchester | 451/541 |
| 2,094,894 A | | 10/1937 | Johnson | |
| 2,465,569 A | | 3/1949 | Bates | |
| 2,853,838 A | | 9/1958 | Richards | |
| 3,364,630 A | * | 1/1968 | Rusk et al. | 451/490 |
| 3,557,496 A | | 1/1971 | Martin | |
| 3,640,031 A | | 2/1972 | Descant | |
| 3,722,150 A | | 3/1973 | Pass | |
| 4,249,349 A | | 2/1981 | Rueb | |
| 4,464,836 A | * | 8/1984 | Hissa | 30/92 |
| 4,501,096 A | | 2/1985 | Lukianoff | |
| 4,887,396 A | | 12/1989 | Lukianoff | |
| 5,203,123 A | | 4/1993 | Travis | |
| 5,220,752 A | | 6/1993 | Cheney et al. | |
| 5,309,681 A | | 5/1994 | Cheney et al. | |
| 5,419,087 A | | 5/1995 | Haddy | |
| 5,651,728 A | | 7/1997 | Stanzione | |
| 6,503,612 B1 | | 1/2003 | Copeland | |
| 2002/0090902 A1 | | 7/2002 | Draper | |
| 2002/0173258 A1 | | 11/2002 | Biddle et al. | |
| 2003/0060150 A1 | | 3/2003 | Spears | |
| 2003/0104777 A1 | | 6/2003 | Deshler | |

* cited by examiner

*Primary Examiner*—Dung Van Nguyen
(74) *Attorney, Agent, or Firm*—J. Gordon Lewis

(57) ABSTRACT

A disposable sanding device is fabricated as a continuous rope-like article which is adapted for selective segmentation and application as a plurality of serially arranged disposable hand sanding devices or ropes. Each hand sanding device is formed as a generally elongated rod shaped base portion formed of lightweight material such as closed cell foam having a relatively constant cross-section along its line of elongation. An abrasive surface is permanently applied to the external surface of the base portion via an intermediate adhesive layer. As constructed, the sanding device is operable to conform to curvilinear contours of a work piece to be sanded upon application of user induced loading against the work piece. A dispenser holds a rolled length of sanding rope and includes a cutter feature for severing pieces of sanding rope from the coil as required as well as a retainer for the free end of the coil. A tensioning hand tool holds a severed length of sanding rope for precise applications.

17 Claims, 4 Drawing Sheets

FIG - 1
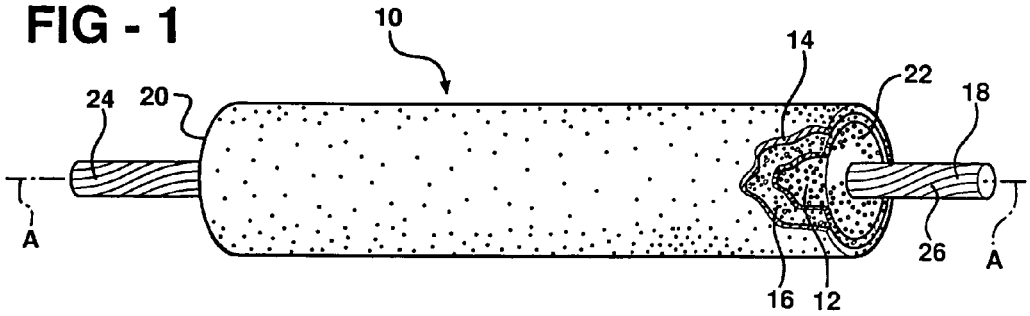
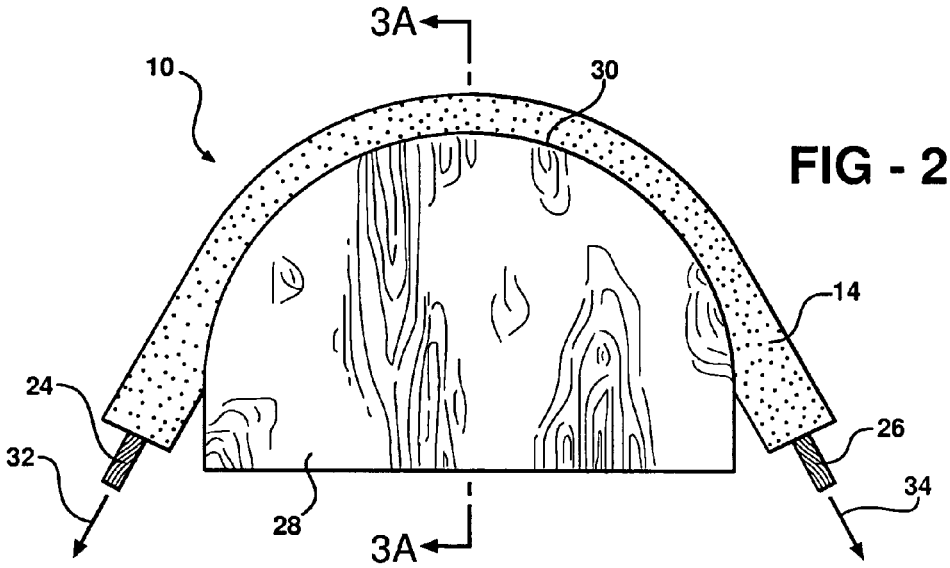
FIG - 2
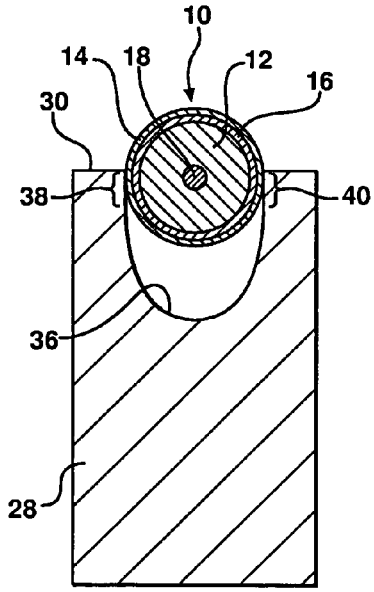
FIG - 3A

FIG - 5
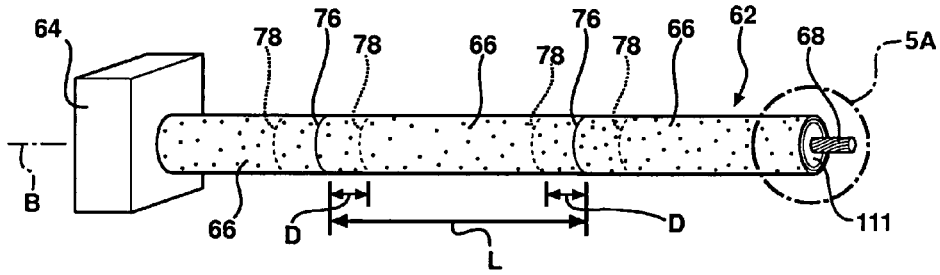
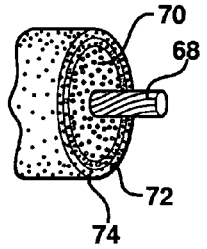
FIG - 5A
FIG - 6
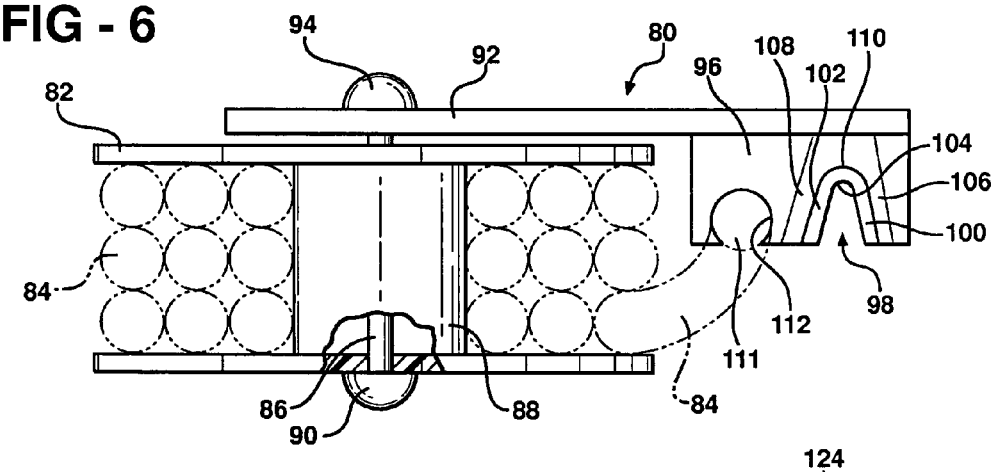
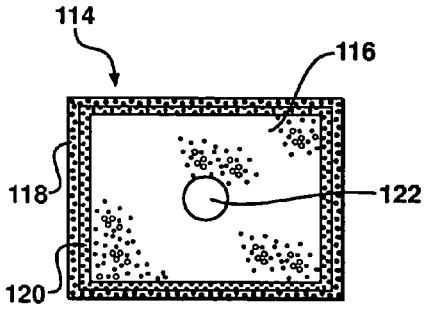
FIG - 7
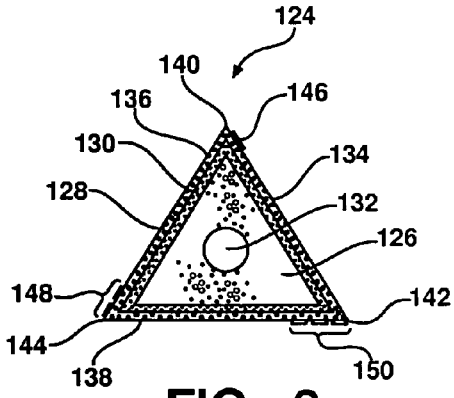
FIG - 8

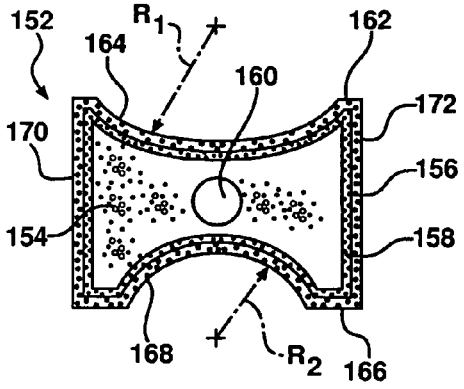
FIG - 9
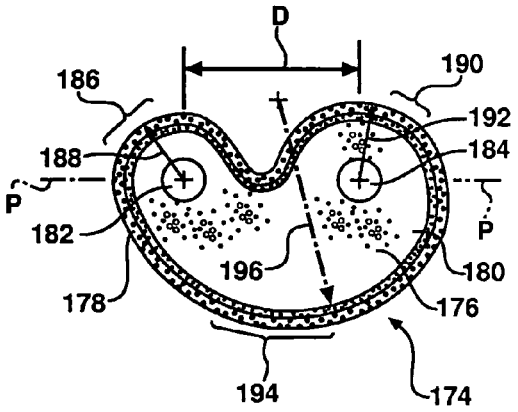
FIG - 10
FIG - 11
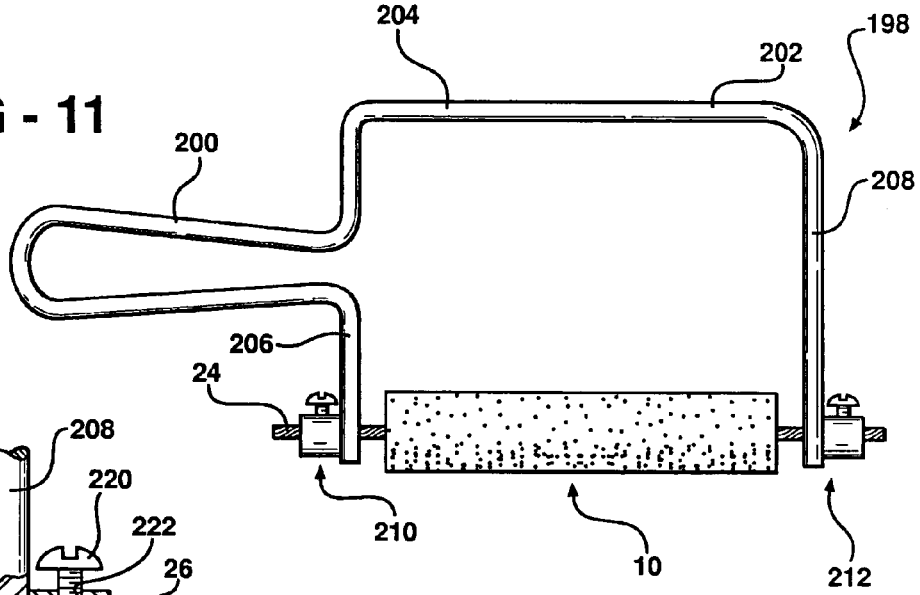
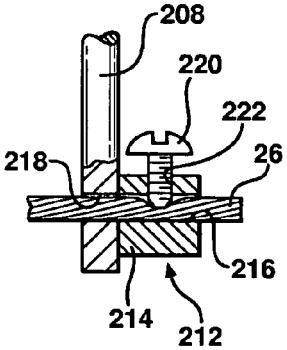
FIG - 11A

SANDING ROPE AND METHOD OF FORMING SAME

The present invention relates generally to hand tools and particularly to sanding devices, especially for use in wood working. More particularly still, the present invention relates to a low cost hand-held disposable sanding device which can be easily manipulated by hand for sanding and finishing a wide variety of work piece surface shapes and configurations.

BACKGROUND OF THE INVENTION

Small sanding jobs and sanding jobs calling for considerable detail work or access to small confined areas will usually require the direct hand application of sandpaper of one or more suitable grit sizes. The difficulty in hand-sanding is in applying firm pressure long enough to complete the job and in applying even pressure to obtain a desired smooth and even finish. A further difficulty is to obtain efficient use of the sandpaper by not wasting any substantial portion of its surface area.

Common sanding jobs calling for considerable detail work or access to small confined areas, or for the sanding of contoured surfaces, will often require that the surfaces be hand sanded. Therefore, hand-held sanding devices devised for this purpose consist essentially of a sanding block for holding conventional sandpaper wrapped over the block. By using a sanding block as a sandpaper holder, hand-applied sanding forces on the sandpaper can be increased and more evenly distributed. One such device is disclosed in U.S. Pat. No. 4,501,096 to Lukianoff, wherein a generally triangularly shaped sandpaper holding device provides three different sanding surfaces and corners for accommodating a variety of sanding conditions. The sandpaper wrapped around the faces of this device is held at its ends by means of an angled slot located in one of its faces.

The difficulty with the above-mentioned prior sanding devices is the necessity of installing or wrapping a separate piece of sandpaper around the device. This installation or wrapping process presents some inconvenience to the user, and the paper, if improperly installed, is susceptible to falling off. Also, the device requires the purchase of separate sheets of sandpaper which is a further inconvenience in terms of the amount of supplies needed.

Sanding blocks are presently available in a variety of forms in an attempt to meet the needs of those who must sand various surfaces. Perhaps the most common sandpaper support is a block of wood from which one may move through myriad supports and into complex electric sanders. In virtually all of these items, the general purpose of the sanding block is three fold.

First, it allows the user to apply greater pressure to the area being sanded. Secondly, it moves the user's hand away from the work surface, usually by providing a handle for the user to grasp, in order to reduce the likelihood of injuries. Thirdly, when a sanding block having a flat sanding paper supporting surface is used to sand a flat surface, the block reduces points of excessive pressure by more evenly distributing the user's force over the sandpaper supporting surface. However, when non-flat surfaces need to be sanded, difficulties often arise. The standard sanding block has a relatively large, flat sandpaper supporting surface which does not satisfactorily meet the needs of one who is sanding an irregular surface. The use of such a sanding block on an irregular surface will generally result in the user angling the block or using it in a way in which it was not intended in an attempt to conform the sanding surface to the work surface. Even with such attempts, the resultant effect is uneven sanding as generally no portion of the block will conform exactly to the area being sanded and excessive areas of pressure which will result in over sanding.

Excessive pressure points can also result in the quickened wearing of the sandpaper, such that the sanding block itself may become exposed, which, depending upon the fabrication of the sanding block, may damage the work surface. Similarly, as the user angles the sanding block in order to utilize a corner or edge of the sandpaper, a portion of the block not covered by the sandpaper may scratch the work surface.

In an attempt to provide sanding blocks which are usable on irregular surfaces, a wide variety of devices have been developed. For example, U.S. Pat. No. 3,557,496 to R. W. Martin discloses a metal strap to which a piece of sandpaper may be secured. The strap is then placed over a pipe or other circular type object so that a back and forth motion may be applied to sand the item. A circular piece of sandpaper is also secured over the handles which are particularly adapted for sanding the inner edges of the pipes. Other patents disclose devices such as special sandpaper holders for louver doors, U.S. Pat. No. 3,640,031 to Descant; sanding fittings, U.S. Pat. No. 3,722,150 to Pass; abrading corners and crevices as shown in U.S. Pat. No. 2,465,569 issued to Bates. While such devices may be suitable for their intended uses, they do not sufficiently meet the myriad surface irregularities often encountered when sanding a complex work piece.

Thus, an individual faced with the task of sanding a variety of irregular surfaces, must either attempt to use different types of sanding blocks, many of which still will not conform to the actual intended use, or in the alternative, those experienced in this area will use their hand in order to conform and support the sandpaper to the work piece. Attempting to enhance this latter approach are devices which either secure the sandpaper directly to the users hand or to a specialized glove.

It should be easily appreciated that these later approaches, while at times effective, are not reasonable alternatives when extreme precision or small detailed contours, such as in furniture finishing, are involved.

The present invention overcomes the forgoing difficulties of hand-held sanding devices by providing a hand-sized sanding device which eliminates the need for a separate sheet of sandpaper. A sanding device is particularly provided which has its own integral abrasive surfaces and which can be manufactured at a sufficiently low cost to be disposable. The invention further provides a self-contained sanding device that can be conveniently used off-the-shelf to hand sand a variety of standard, contoured or shaped surfaces, such as trim or molding surfaces, and for projecting into restricted exactly defined areas.

BRIEF DESCRIPTION OF THE INVENTION

An object of the present invention is to develop a low cost (and thus disposable) hand held sanding device made of lightweight, resilient material capable of recovering its shape after being subjected to radial or axial pressures attendant its usage as a sanding device. The device has a contoured outer surface which can be deformed to match the small, intricate shapes of furniture balusters, moldings and trim. While shaped molding and trim are specifically identified as possible contoured shapes to which the sanding device of the invention can be applied, it shall be understood that the contoured surface of the device can be applied with almost any sandable surface and material.

According to the present invention, a disposable hand sanding device includes an elongated, generally rod shaped base portion which is constructed of lightweight resilient material such as closed cell foam or rubber and is formed with a substantially constant cross-section along its characteristic line of elongation. An abrasive outer surface layer is permanently formed on the base portion by adhering abrasive material such as silicon carbide or aluminum oxide upon an intermediate adhesive layer. This arrangement results in a hand held device which, in application, conforms to curvilinear contours of a work piece to be sanded upon application of user induced loading against the workpiece. The device is light weight, easy to use and is extremely inexpensive to manufacture.

As an additional feature, an elongated, non-resilient flexible cord is embedded within the base portion and extends substantially concentrically with the base portion to limit axial distension of the sanding device upon application of user induced loading. The cord, when exposed, also facilitates manual manipulation of the sanding device.

In the preferred embodiment of the invention, a continuously formed rope-like article is provided which can be selectively cut to length for a specific sanding application. The rope-like article is maintained in a roll. Segments removed from the roll are used and then discarded. This arrangement has the advantage of continuously forming multiple "sanding ropes" in series or a succession such as by extrusion. An artisan can easily maintain the unused roll portion and sever just the length segment required for a specific sanding application.

A dispenser can also be provided which maintains the continuously formed rope-like article in a rotating spool mounted on a frame member which includes a cutter and a loose end holder. This arrangement provides an extremely convenient package which facilitates removal of a length of sanding rope material from the storage roll without the necessity of using additional tools, such as a cutting device.

An additional feature includes witness marks located on the outer surface of the rope-like material which are axially spaced from one another to serve as an indicator or measurement to the artisan in selecting an appropriate amount of length of material to sever. Furthermore, localized weakened areas such as perforations are provided to assist in the stripping off of a short length of base portion to expose an underlaying length of inner cord to aid in the manipulation of the severed piece.

A severed length of sanding rope with its internal cord exposed at each end thereof can be employed with a hand held tool, similar to a key hole saw frame, which provides precisely controlled tensioning of the cord in application to a work piece.

These and other features and advantages of this invention will become apparent upon reading the following specification which, along with the drawings, describes and discloses preferred and alternative embodiments of the invention in detail.

BRIEF DESCRIPTION OF THE DRAWINGS

FIG. 1, is a perspective view of a disposable hand sanding device in accordance with the invention with a portion broken away to reveal internal structural elements thereof;

FIG. 2, is a front plan view of the hand sanding device of FIG. 1 in application of forming, sanding or shaping a work piece;

FIG. 3A, is a cross-section, taken on lines 3A—3A of FIG. 2;

FIG. 5, is a broken perspective view of a continuous chain of disposable hand sanding devices;

FIG. 5A, is a depiction of the end of the continuous chain of disposable hand sanding devices of FIG. 5, on an enlarged scale;

FIG. 6, is a top plan view of a dispenser of the continuous chain of disposable hand sanding devices of FIG. 5;

FIG. 7, is a cross-sectional view of an alternative embodiment of the present invention;

FIG. 8, is a cross-sectional view of another alternative embodiment of the present invention;

FIG. 9, is a cross-sectional view of still another alternative embodiment of the present invention;

FIG. 10, is a cross-section view of yet still another alternative embodiment of the present invention;

FIG. 11, is a plan view of a tool for facilitating use of the hand sanding device of FIG. 1; and FIG. 11A, is a depiction of a portion of the tool for facilitating use of the hand sanding device of FIG. 11, on an enlarged scale.

DETAILED DESCRIPTION

Figure 3B:
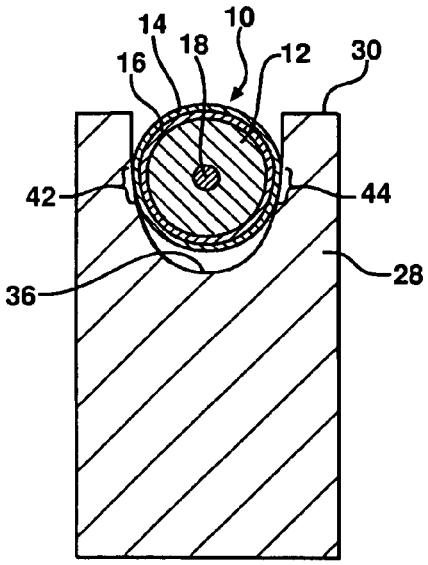
FIG. 3B, is a cross-section, taken on lines 3A—3A of FIG. 2, with the sanding device in an alternative orientation with respect to the work piece.

FIG. 1 illustrates a preferred embodiment of the present invention. A disposable sanding rope or device 10 is formed as a generally rod shaped base portion 12 elongated along an axis designated A—A. Base portion 12 is preferably formed from lightweight resilient material such as closed cell foam or rubber. It is contemplated that many other suitable materials such as urethane or neoprene could be substituted, however, based upon an understanding of the present invention and a given specific application.

The outer circumferential surface of base portion 12 is substantially covered with an abrasive coating layer 14 suitably affixed to the underlying base portion 12 by an intermediate adhesive layer 16. Adhesive layer 16 is spray applied to base portion 12 prior to application of a suitable aggregate abrasive 14 such as coarse aluminum oxide or silicon carbide. Such materials are commercially available from the Household and Hardware Products Division of the 3M Company under a number of product names. One type of spray adhesive that can be used is "Spray Mount" No. 6065 produced by 3M Adhesives Division of the 3M Company. This construction allows momentary resilient deformation of the sanding rope 10 as it engages a work piece. Upon completion of the sanding process, the sanding rope returns to its illustrated shape. Alternatively, abrasive layer 14 could be formed of traditional sand paper which is, in turn, adhered to base portion 12 by adhesive layer 16.

A reinforcing cord 18, formed of woven fibrous material such as cotton or nylon, extends along axis A—A within base portion 12 of sanding rope 10. Cord 18 is flexible in the radial direction and inflexible in the axial direction and thus serves to limit axial distension of sanding rope 10 when applied against a work piece. Furthermore, cord 18 also extends axially beyond the longitudinal ends 20 and 22 of base portion 12 to define grip handles 24 and 26.

Sanding rope 10 is intended for hand sanding complex curvilinear surfaces of work pieces such as wooden furniture or moldings. Rope 10 is employed by either grasping the abrasive layer by the user's finger tips or palm of the hand and applying force against a work piece. In this manner the tactile sense of the operator's hand allows continuous variation in force applied against the work piece and thus the rate and configuration of sanding. This is useful for non-symmetrical or custom surface features.

Alternately, for work piece surfaces which are regular or symmetrical in at least one plane, grip handles 24 and 26 can be held by the fingertips of the user's respective right and left hands. Insodoing, the user tensions cord 18 along axis A—A. The user then positions the abrasive surface 14 of rope 10 against a specific feature of the work piece to be sanded and alternatively pulls grip handles 24 and 26 along axis A—A. This action will largely conform the local circumferential shape of the sanding rope 10 to the adjacent contour features of the work piece. As grip handles 24 and 26 are alternatively pulled in one direction and then another along axis A—A, the portion of abrasive layer 14 of sanding rope 10 contacting the work piece reshapes its surface. The amount of tension applied along the cord 18 will control the degree in which the abrasive layer will conform to the work piece. For example, if very little tension is applied to cord 18, the sanding rope 10 will tend to increase its "wrap" or engagement with convex surface features of the work piece. Conversely, if the cord 18 is placed under high tension, sanding rope 10 will tend to decrease its "wrap" around convex surfaces. Accordingly, an amount of user experience and test sanding of material similar to that contained in an intended work piece will facilitate skilled use of the present invention.

Referring to FIG. 2, sanding rope 10 is illustrated in application with a work piece 28. The work piece 28 is of relatively simple geometric form for purposes of illustration only, it being contemplated that the present invention is best applied with extremely irregular contoured surfaces. The work piece 28 is configured as a generally rectangular block of wood having an upper surface 30 with a generally rounded configuration. Sanding rope 10 is applied by draping it over upper surface 30 with cord 18 extending generally from left to right. Grip handles 24 and 26 are alternatively pulled leftwardly, as illustrated by arrow 32, and then rightwardly, as illustrated by arrow 34. As described hereinabove, the user will maintain continuous tension in cord 16 throughout this process.

Referring to FIGS. 2 and 3A, sanding rope 10 is being employed to form a generally saddle or crescent shaped groove 36 in upper surface 30 of work piece 28. When subjected to very low tension forces in the direction of arrows 32 and 34, the base portion 12 of sanding rope 10 substantially maintains its nominal circular configuration. As such, only a small portion of the abrasive layer 14 adjacent the intersection of the uppermost portion of groove 36 and upper surface 30 conforms to the adjacent portion of the groove 36 at regions designated 38 and 40. Therefore, axial manipulation of sanding rope 10 will result in removal of material at regions 38 and 40.

Referring to FIGS. 2 and 3B, sanding rope 10 is illustrated as being subjected to intermediate tension forces in the direction of arrows 32 and 34. As a result, sanding rope is displaced further within groove 36 and conforms thereto at adjacent regions designated 42 and 44. Again, axial manipulation of sanding rope 10 will result in removal of material at regions 42 and 44.

Figure 3C:
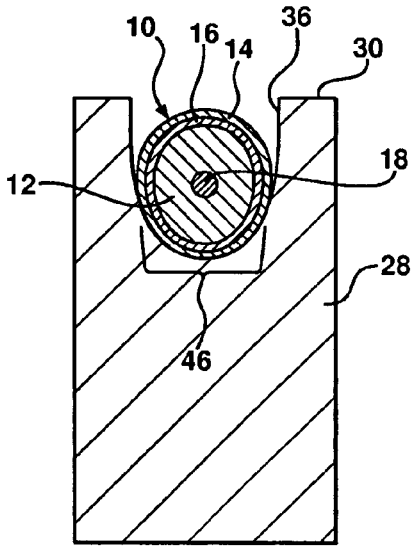
FIG. 3C, is a cross-section, taken on lines 3A—3A of FIG. 2, with the sanding device in another alternate orientation with respect to the work piece.

Referring to FIGS. 2 and 3C, sanding rope 10 is illustrated as being subjected to relatively high tension forces in the direction of arrows 32 and 34. As a result, sanding rope 10 is displaced into the bottom of groove 36 and conforms thereto at a single adjacent region 46. Axial manipulation of sanding rope 10 will result in removal of material at region 46.

The various positionings of sanding rope 10 in FIGS. 3A, 3B and 3C serve to illustrate how an artisan using sanding rope 10 can skillfully and precisely remove material from a complex recess in a work piece by varying the tension applied to the cord 18 of sanding rope 10. Varying the positioning of the sanding rope 10 vis-a-vis the groove 36 causes momentary localized deformation of the base portion 12 and the abrasive coating layer 14 as well as the intermediate adhesive layer 16. Upon removal of the sanding rope 10 from engagement with the work piece 28, the overall shape of the sanding rope 10 will return to the generally cylindrical configuration illustrated in FIG. 1.

Figure 4:
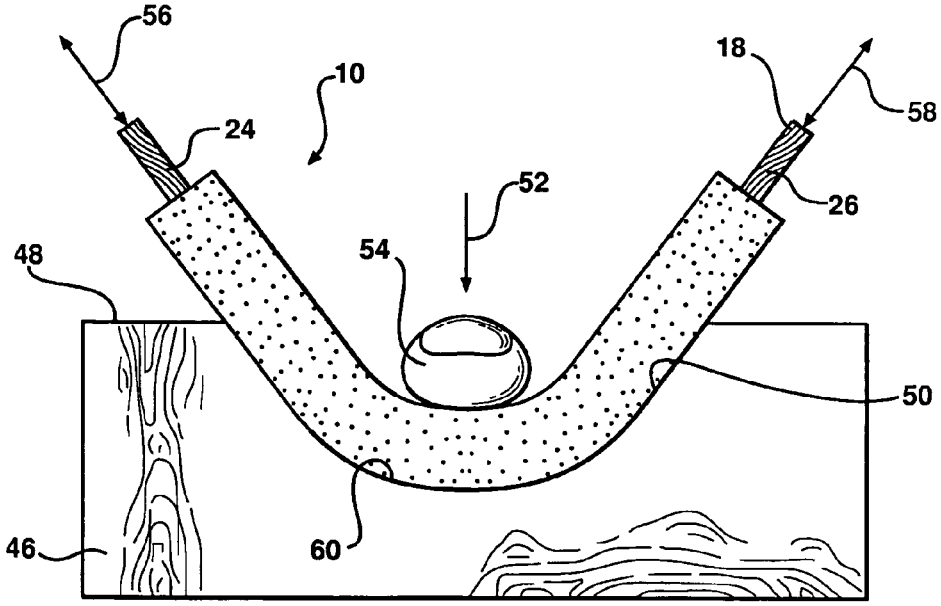
FIG. 4, is a front plan view of the hand sanding device of FIG. 1 in application of forming another work piece.

Referring to FIG. 4, an alternative application of the sanding rope 10 described in connection with FIG. 1 is illustrated. Sanding rope 10 is illustrated in FIG. 4 in application with a work piece 46. As in the case of work piece 28 described in connection with FIG. 2, work piece 46 is of relatively simple geometric form for purposes of illustration only, it being contemplated that the present invention is best applied with extremely irregular contoured surfaces. The work piece 46 is configured as a generally rectangular block of wood having an upper surface 48 with a generally concave feature 50 formed therein. Sanding rope 10 is applied to work piece 46 by conforming it generally to the contours of concave feature 50 on upper surface 48 of work piece 46. Sanding rope is maintained in its illustrated position by the artisan applying pressure, as indicated by arrow 52, from one or more finger tips 54. While holding sanding rope 10 in position, the artisan would apply his other hand to grasp either of the grip handles 24 or 26 and apply tension to cord 18, as illustrated by arrows 56 and 58, respectively. Increasing or decreasing pressure (arrow 52) will deform the base portion 12 of sanding rope 10 and thus increase or decrease the amount of abrasive layer that is bearing against the adjacent area 60 of concave feature 50. This will result in precisely controlled removal of material at region 60 in response to axial manipulation of sanding rope 10.

Referring to FIGS. 5 and 5A, to facilitate economical large scale production of sanding rope 10 such as illustrated in FIG. 1, it would be formed in an endless or continuous stream 62 emerging from appropriate manufacturing equipment 64, such as an extruder, along an axis B—B. The continuous stream 62 of sanding rope preferably has a typical cross-section configuration substantially identical to that described with respect to the sanding rope 10 segment of FIG. 1. The continuous stream 62 comprises successive segments of sanding rope 66 joined end-to-end along axis B—B.

The continuous stream 62 structure consists of concentrically arranged cord 68, base portion 70, adhesive layer 72 and abrasive coating layer 74. Witness marks 76 are imprinted on the outer surface of abrasive coating layer 74 at axially spaced locations therealong. Weakened areas 78 such as perforations are formed at axially spaced locations as well. The witness marks are indicators of suggested locations for severing one specific sanding rope segment 66 from an immediately adjacent segment 66. The applicant has discovered that spacing (designated "L") between successive witness marks of eight (8") to twelve (12") inches results in sanding rope segments 66 of convenient length for many craft and hobby applications.

Perforations 78 are provided at a location spaced from each end of each sanding rope segment 66. The perforations extend inwardly through abrasive coating layer 74, adhesive layer 72 and substantially all of base portion 70. The cord 68 is not weakened, however. The portions of the abrasive layer 74, adhesive layer 72 and base portion 70 intermediate the (severed) witness marks 76 and a related perforation 78 are optionally removable to expose a segment of the underlying cord 68. The applicant has discovered that the exposed cord 68 portion, i.e. the spacing (designated "D") between each witness mark 76 and its associated perforations 78 of one (1") to two (2") inches results in a convenient length of exposed cord 68 for finger grasping by the artisan in application of a given sanding rope segment 66 without undue waste of material.

When constructed in a continuous stream 62, the sanding rope segments 66 of the present invention can be easily packaged and marketed in bulk or rolls. Referring to FIG. 6, an example roll dispenser 80 for retail sales of a substantial length (such as 10' to 25') is illustrated. A spool 82 dimensioned to receive and hold an extended length of sanding rope 84 (shown in phantom) is mounted for rotation on an axle 86 extending concentrically through the hub 88 of spool 82. The lower end of axle 86 is affixed to a stop member 90 which functions to prevent relative upward displacement of the axle 86 with respect to hub 88 but allow free relative rotation between the two. Axle 86 extends upwardly above spool 88 and through a frame member 92, terminating in a second stop member 94. Stop member 94 is affixed to both the uppermost end of axle 86 and frame member 92, and prevents relative downward displacement of the axle 86 with respect to hub 88. Thus, frame 92, axle 86, and stop members 90 and 94 comprise one rigid, fixed assembly. Spool 82 (and any sanding rope 84 carried thereon) is free to rotate about axle 86 but is restrained from relative axial displacement with respect to the remainder of roll dispenser 80.

Frame member 92 of roll dispenser 80 extends radially outwardly beyond spool 82 and terminates in a cutter/retainer portion 96. Cutter/retainer portion 96 serves as an integrated tool for conveniently severing one or more sanding rope segments 66 (see FIG. 5) as required. Subsequently, the free end 111 of the extended length of sanding rope 84 remaining on spool 82 ia retained in its illustrated position to prevent inadvertent uncoiling of the extended length of sanding rope 84 remaining on the spool 82. Cutter/retainer portion defines a generally "V" shaped cutter 98 defining converging sharpened edges 100 and 102. A pocket 104 formed in the cutter 98 adjacent the point of closest approach of edges 100 and 102 is dimensioned to receive the cord 68 of a sanding rope segment 66 being severed from the remaining length of sanding rope 84 remaining on the spool 82. Thickened guide walls 106, 108 and 110 coact with cutting edges 100, 102 and pocket 104, respectively, to precisely guide the segment of sanding rope 66 being severed to ensure a clean perpendicular cut occurs. Cutter/retainer portion 96 also defines a necked opening 112 dimensioned to enable the user to press fit the free end 111 of the extended length of sanding rope 84 remaining on the spool 82 during storage.

Referring to FIG. 7, an alternative configuration of the sanding rope 10 described with reference to FIG. 1, is illustrated. A sanding rope 114, illustrated in typical cross-section, comprises a base portion 116 formed in a generally square or rectangular configuration. The outer circumferential surface of base portion 116 is substantially covered by an abrasive coating layer 118 which is affixed to the base portion 116 by an intermediate adhesive layer 120. A reinforcing cord 122, formed of woven fibrous material extends axially through the base portion 116. The sanding rope 114 provides multiple flat normally disposed surfaces and intermediate sharp corners suitable for certain sanding requirements.

Referring to FIG. 8, another alternative configuration of the sanding rope described with reference to FIG. 1, is illustrated. A sanding rope 124, illustrated in typical cross-section, comprises a base portion 126 formed in a generally triangular configuration. The outer circumferential surface of base portion 126 is substantially covered by an abrasive coating layer 128 which is fixed to the base portion 126 by an intermediate adhesive layer 130. A reinforcing cord 132 formed of woven fibrous material extends axially through the base portion 126. The sanding rope 126 provides three acutely angled flat surfaces 134, 136 and 138 intersected by intermediate corner edges 140, 142 and 144. Each surface 134, 136 and 138 has a significantly different grit size or coarseness characteristic. Furthermore, each surface 134, 136 and 138 carries unique visible or tactile indicia indicative of its relative degree of coarseness.

In the case of this embodiment of the invention, the indicia comprise single, dual and treble sets of axially extending brightly colored stripes 146, 148 and 150. Alternatively, numerical grit or coarseness ratings could be provided on each side surface 134, 136 and 138 as an aid to the artisan.

Referring to FIG. 9, still another alternative embodiment configuration of the sanding rope described with reference to FIG. 1, is illustrated. A sanding rope 152, illustrated in typical cross-section, comprises a base portion 154 formed in a generally hour glass configuration. The outer circumferential surface of base portion 154 is substantially covered by an abrasive coating layer 156 which is fixed to the base portion 154 by an intermediate adhesive layer 158. A reinforcing cord 160 formed of woven fibrous material extends axially through the base portion 154. The top surface 162 of sanding rope 152 has an axially extending concave recess 164 formed therein. Recess 164 has a characteristic relatively constant radius designated by arrow "R1". Likewise, the bottom surface 166 of sanding rope 152 has an axially extending concave recess 168 formed therein. Recess 168 has a characteristic relatively constant radius designated by arrow "R2". It is contemplated that R1 and R2 may be dimensionally the same or, alternatively, substantially varied. Side walls 170 and 172 of sanding rope 152 are illustrated as being substantially flat. However, they could be formed as concave, convex or otherwise curvilinear surfaces to suit any number of varied sanding jobs.

Referring to FIG. 10, a further alternative embodiment configuration of the sanding rope described with reference to FIG. 1, is illustrated. A sanding rope 174, illustrated in typical cross-section, comprises a base portion 176 having an exterior surface which is continuously curvilinear in shape. The outer circumferential surface of base portion 176 is substantially covered by an abrasive coating layer 178 which is fixed to the base portion 176 by an intermediate adhesive layer 180. Two reinforcing cords 182 and 184 formed of woven fibrous material extend axially through the base portion 176. Cords 182 and 184 are parallel and fall upon an imaginary plane designated "P—P". Sanding rope 174 is asymmetrical in overall shape to define convexly curved surfaces of varying radius. Specifically, the upper left hand portion of base portion 176 defines a region 186 of relatively small varying radius designated by arrow 188. The upper right hand portion of base portion 176 defines a region 190 of intermediate varying radius designated by arrow 192. The bottom portion of base portion 176 defines a region 194 of relatively large varying radius designated by arrow 196. Cord 182 extends through the portion of base portion 176 adjacent region 186 and cord 184 extends through the portion of base portion 176 adjacent region 190. Cords 182 and 184 provide enhanced control of sanding rope 174 when regions 186 and 190, respectively, are being employed in a sanding operation.

When both cords 182 and 184 are subjected to tensioning by an artisan in application, sanding rope becomes relatively inflexible within plane P—P, thus proving another measure of control.

Referring to FIGS. 11 and 11A, a tensioning tool 198 suitable for use with the sanding rope 10 described in connection with FIG. 1, is illustrated. Tool 198 can be applied in circumstances where extremely precise control of sanding rope 10 is required to effect sanding of a workpiece with curvilinear features having a section which is straight in at least one direction.

Tensioning tool 198 is similar in some cosmetic respects to a conventional key-hole saw. Tool 198 is formed from relatively stiff drawn steel wire that is square or round in cross-section. The wire is bent to form a handle portion 200 integrally formed with a generally "U" shaped bow frame 202. Bow frame 202 consists of a base portion 204 and two legs 206 and 208 extending therefrom in cantilever fashion. Legs 206 and 208 extend downwardly, terminating in sanding rope clamping assemblies 210 and 212, respectively.

Clamping assemblies 210 and 212 are substantially identical. Accordingly, the detailed structure of only one will be described herein for the sake of brevity. Clamp assembly 212 includes an annular ring 214 defining a through bore 216. Through bore 216 of ring 214 registers with a similarly dimensioned and aligned through bore 218 formed in leg 208 near the free end thereof. Legs 206 and 208 are generally parallel and are spaced to receive the sanding rope 10 described in connection with FIG. 1. In application, grip handle or cord segment 26 of sanding rope 10 is threaded rightwardly through bores 218 and 216, extending slightly therebeyond. A set screw 220 which is threadably engaged within a bore 222 in ring 214 normal to and communicating with bore 216, is then tightened to secure grip handle 26 in its illustrated position. The process is then repeated wherein grip handle 24 is secured to leg 206 via clamp assembly 210. As a final step, the free ends of legs 206 and 208 are momentarily forcibly sprung towards one another. Set screw 220 is loosened and grip handles 24 and 26 are pulled in opposed directions (tensioned). Finally, set screw 220 is retightened. This arrangement results in bow portion 202 of tool 198 acting to maintain a predetermined level of tension in sanding rope 10. Thereafter, sanding rope is employed in its intended manner by the artisan grasping and manipulating the tool 198 by its handle 200.

It is to be understood that the invention has been described with reference to specific embodiments and variations to provide the features and advantages previously described and that the embodiments are susceptible of modification as will be apparent to those skilled in the art. For example, any number of characteristic cross-sectional configurations of the inventive sanding rope can be employed for various applications.

Furthermore, it is contemplated that many alternative common inexpensive materials can be employed to construct the rope core, abrasive coating and string reinforcement. For example, abrasive coating can be applied in a powdered, granular or preformed sheet form. Accordingly, the forgoing is not to be construed in a limiting sense.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A disposable hand sanding device comprising:

an elongated, generally rod shaped base portion constructed of lightweight resilient material having a substantially constant cross-section along a characteristic line of elongation;

an abrasive surface formed on an external surface of the rod base portion operable to conform to curvilinear contours of a work piece to be sanded upon application of user induced loading against the work piece; and an elongated non-resilient, flexible cord embedded within said base portion and extending substantially concentrically with said base portion to limit axial distension thereof upon application of user induced loading.

2. The disposable hand sanding device of claim 1, wherein said abrasive surface covers substantially the entire external circumferential surface of said base portion.

3. The disposable hand sanding device of claim 1, wherein said base portion is constructed of foam material.

4. The disposable hand sanding device of claim 1, further comprising witness marks disposed on the exterior surface thereof at axially spaced locations therealong.

5. The disposable hand sanding device of claim 1, further comprising a localized weakened area of said rod shaped base portion suitable for selective separation of the device into two or more abbreviated devices.

6. The disposable hand sanding device of claim 5, wherein said localized weakened area comprises a perforation extending at least partially radially through said base portion.

7. The disposable hand sanding device of claim 1, wherein said cord is formed of woven, rope-like material.

8. The disposable hand sanding device of claim 1, further comprising a layer of adhesive material disposed intermediate the outer peripheral surface of said base portion and material forming said abrasive surface.

9. The disposable hand sanding device of claim 1, wherein said base portion has a substantially round cross-section.

10. The disposable hand sanding device of claim 1, wherein said base portion has a generally polygonal characteristic cross-section.

11. The disposable hand sanding device of claim 1, wherein said base portion defines a generally concave contour on the outer peripheral surface thereof.

12. The disposable hand sanding device of claim 1, further comprising:

a plurality of elongated, non-resilient flexible cords embedded within said base portion in a spaced relationship and extending generally parallel with said base portion line of elongation to limit axial distension thereof as well as flexibility of said device within an imaginary plane defined by two of said cords.

13. A continuously formed rope-like article adapted for selective segmentation and application as a plurality of serially arranged disposable hand sanding devices, said article comprising:

an elongated, generally rod shaped base portion constructed of lightweight resilient material having a substantially constant cross-section along a characteristic line of elongation;

an abrasive surface formed on an external surface of the rod base portion operable to conform to curvilinear contours of a work piece to be sanded upon application of user induced loading against the work piece; and witness marks disposed on the exterior surface thereof at axially spaced locations therealong.

14. The disposable hand sanding device of claim 13, further comprising an elongated non-resilient, flexible cord embedded within said base portion and extending substantially concentrically with said base portion to limit axial distension thereof upon application of user induced loading.

15. The disposable hand sanding device of claim 13, further comprising a localized weakened area of said rod shaped base portion suitable for selective separation of the device into two or more abbreviated devices.

16. The disposable hand sanding device of claim 15, wherein said localized weakened area comprises a generally circumferential perforation extending at least partially radially through said base portion.

17. The disposable hand sanding device of claim 15, further comprising a plurality of such localized weakened areas at axially spaced locations along said rod shaped base portion.

* * * * *